US005597239A

United States Patent [19]

Scaramuzza et al.

[11] Patent Number: 5,597,239

[45] Date of Patent: Jan. 28, 1997

[54] SPHERIC CAP BEARING DEVICE FOR SAFELY CONNECTING ELEMENTS OF BRIDGES, VIADUCTS, BUILDINGS AND THE LIKE

[75] Inventors: Mauro Scaramuzza; Mauro Piccolo, both of Selvazzano Dentro, Italy

[73] Assignee: FIP Industriale S.p.A., Selvazzano Dentro, Italy

[21] Appl. No.: 537,532

[22] Filed: Oct. 2, 1995

[30] Foreign Application Priority Data

Oct. 4, 1994 [IT] Italy ..... MI94A2024

[51] Int. Cl.[6] ..... F16C 31/02

[52] U.S. Cl. ..... 384/36; 52/167.4

[58] Field of Search ..... 384/36, 42; 52/167.4, 52/167.5, 167.6, 167.7, 167.8, 167.9

[56] References Cited

U.S. PATENT DOCUMENTS 3,971,598 7/1976 Rudge ..... 364/36
4,238,137 12/1980 Furchak et al. ..... 384/36
4,320,549 3/1982 Greb ..... 52/167
4,644,714 2/1987 Zayas ..... 52/167

*Primary Examiner*—Lenard A. Footland
*Attorney, Agent, or Firm*—Bucknam and Archer

[57] ABSTRACT

The present invention relates to a spheric cap bearing device for safely connecting elements of bridges, viaducts, buildings and the like, which comprises a bottom element, in which there is provided a recess in which is engaged a spheric cap coupling element the bottom of which is slidably supported on the bottom of the recess.

At the top of the bottom element there is arranged a top element provided, on the bottom side thereof, with a concave recess mating with the spheric surface of the coupling element.

8 Claims, 3 Drawing Sheets

SPHERIC CAP BEARING DEVICE FOR SAFELY CONNECTING ELEMENTS OF BRIDGES, VIADUCTS, BUILDINGS AND THE LIKE

BACKGROUND OF THE INVENTION

The present invention relates to a spheric cap bearing device for safely connecting elements of bridges, viaducts, buildings and the like.

As is known, in the civil or industrial building field, with the generic term "bearing apparatus or device" there are indicated those mechanical devices adapted to provide a connection arrangement to be used by the construction designer for coupling the several structural elements forming the designed work.

Also known is that the specific functions of these bearing devices are as follows: to transmit the loads from the over-structure to the supporting elements, by centering them at the desired points; to allow the necessary turning movements of the over-structure; to resist against horizontal pushing forces, as required, and allow a mutual movement of the connected construction parts, while reducing the stresses deriving from resilient forces or friction.

With reference to the function of allowing a mutual movement of the connected structural parts, prior bearing devices can be considered of three different types.

A first type thereof comprises "fixed" bearing devices, i.e. devices hindering a mutual displacement of the connected structural parts, a second type comprising "unidirectional movable" bearing devices, in which the mutual movements of the connected structural parts can occur according to a single and well defined horizontal direction, coinciding with the sliding axis of the bearing construction.

The third type comprises "multi-direction movable" bearing devices in which the mutual movements can occur according to any horizontal direction.

All the above three mentioned types of bearing devices allow mutual rotary movements of the connected structural parts about any desired axis, and they conventionally comprise a spheric-hinge articulation which is made of a spheric cap element, which is connected to an element of the structure and to which there is coupled an element, including a correspondingly shaped recess, which is in turn connected to the other element of the structure.

One of the main problems of the bearing devices of the "fixed" and "unidirectional movable" types, is that phenomenon which is conventionally called "decapping", and consisting of an anomalous disengagement of the spheric cap from its seat or recess because of the high vertical loads and the horizontal pushing forces, discharging on the spheric cap element.

This problem greatly affects the selection of the bearing device to be used and, frequently, compels to select a bearing device different from the spheric cap bearing device, thereby compelling the designer to trade-off in another manner the fact that is not used a conventional spheric hinge bearing device.

In this connection, it should be pointed out that the designers in this field constantly search for new solutions for making road and railway works as well as civil buildings, by requiring very sophisticated and novel approaches.

SUMMARY OF THE INVENTION

The aim of the present invention is to solve the above mentioned problems, by providing a spheric cap bearing device, which allows any rotary movements, in a very safe manner, that is without originating the above mentioned "decapping" problems which are typical of the prior spheric cap bearing devices.

Within the scope of the above mentioned aim, a main object of the present invention is to provide such a spheric cap bearing device which is practically not affected by the vertical load/horizontal pushing force ratio which usually affects the selection of the bearing device and which frequently brings a designer to select a bearing device different from a spheric cap bearing device.

Another object of the present invention is to provide such a bearing device which is very reliable and safe in operation.

Yet another object of the present invention is to provide such a bearing device which, if required, can be inherently dielectric.

According to one aspect of the present invention, the above mentioned aim and objects, as well as yet other objects, which will become more apparent hereinafter, are achieved by a spheric cap bearing device for safely connecting elements of bridges, viaducts, buildings and the like, characterized in that said bearing device comprises a bottom element, in which is defined a recess engaging therein a spheric cap coupling element, said coupling element having a bottom slidably bearing on the bottom of said recess and a top element having, on a lower side thereof, a concave recess mating with a spheric surface of said coupling element.

BRIEF DESCRIPTION OF THE DRAWINGS

Further characteristics and advantages of the spheric cap bearing device, according to the present invention, will become more apparent hereinafter from the following detailed disclosure of a preferred embodiment of said bearing device, which is illustrated, by way of a merely, but not indicative example, in the figures of the accompanying drawings, where.

DESCRIPTION OF THE PREFERRED EMBODIMENTS

Figure 1:
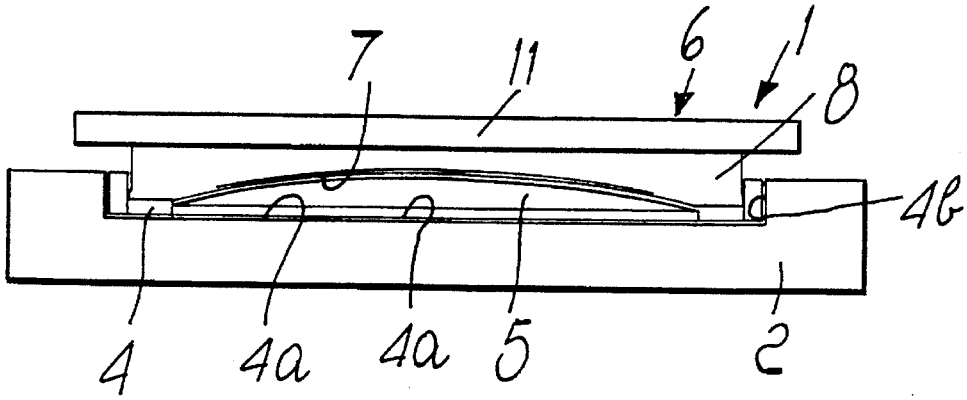
FIG. 1 is a schematic cross-section view of the bearing device according to the present invention.
Figure 2:
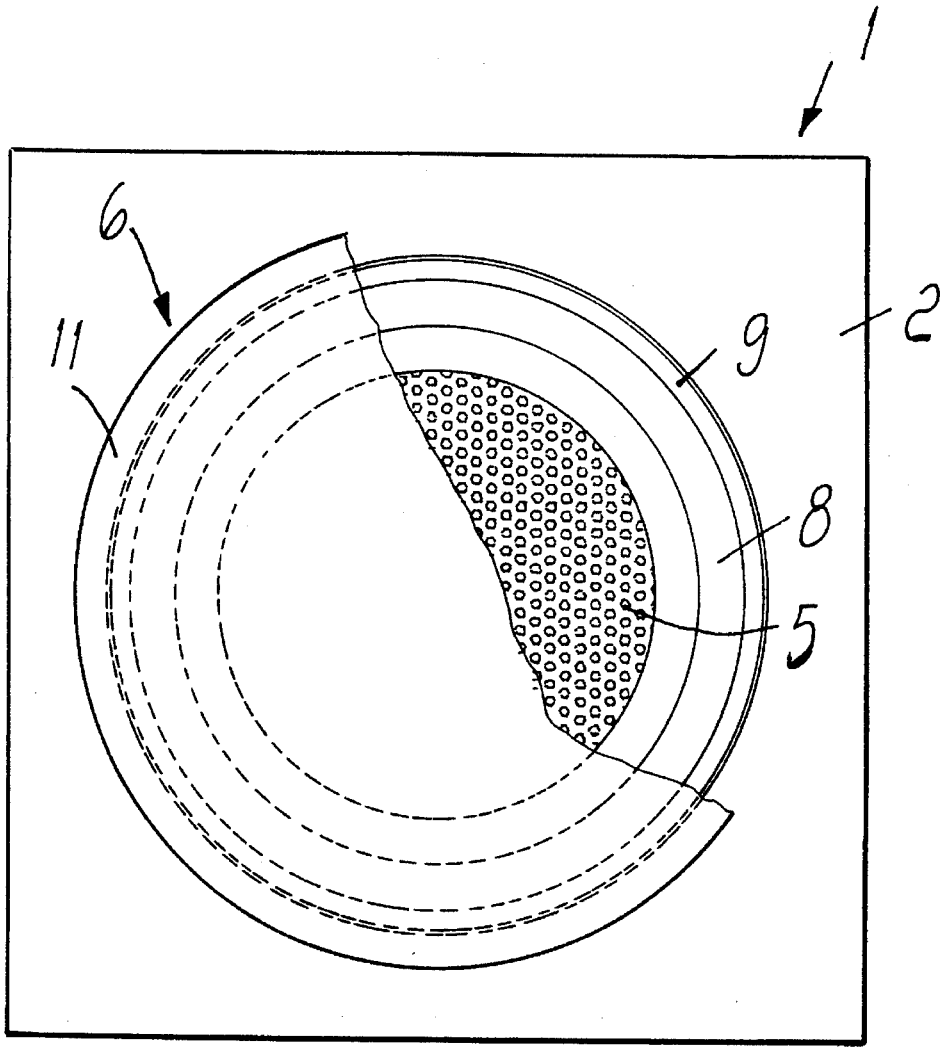
FIG. 2 is another schematic top plan and partially cross sectioned view illustrating the bearing device according to the invention.

With reference to the number references of the above mentioned figures, the spheric cap bearing device according to the present invention, which has been generally indicated at the reference number 1, comprises a bottom element 2, which can be connected to the bottom portion of the structure to be made, for example by means of bottom tierods 3.

On the top surface of the bottom element 2 there is provided a recess 4 which, preferably, has a substantially open-top cylindric configuration.

In the recess 4 there is engaged a coupling element 5 which has a spheric cap shape, and which slidably bears, by the bottom thereof, on the bottom 4*a* of the recess 4.

The subject bearing device also comprises a top element 6 to be connected to the over-structure, and consisting of a plate 11 which is provided, on the lower or bottom side thereof, i.e. on the side thereof facing the bottom element 2, with a concave recess 7, which a spheric surface slidably coupled with the spheric surface of the spheric cap element 5.

More specifically, the concave recess 7 is defined on the bottom face of an extension 8 projecting at the bottom of the plate 11 of the top element 6, and which is partially engaged in the seat 4 of the bottom element 2.

Inside the seat or recess 4, near the cylindric wall 4*b* laterally delimiting said recess, there is coaxially provided an annular element 9, and the extension 8 projects inside said annular element 9.

The annular element 9, in particular, is provided only in those bearing devices which must be inherently dielectric.

Said element is omitted from the "multidirection" type of bearing device, since these devices are made dielectric owing to the PTFE material of the sliding surface thereof.

In order to improve the sliding properties of the coupling element 5 with respect to the bottom 4*a* of the recess 4, the mutually contacting surfaces of these two elements, are coated by a low friction material.

For example, the bottom 4*a* can be coated by a stainless steel material, mirror-like polished, whereas the bottom of the coupling element 5 can be coated by a poly-tetrafluoroethylene material (PTFE).

Moreover, the mutually movable surfaces of the bearing device arcuated by an anti-friction material, preferably a dielectric anti-friction material, so as to render inherently dielectric the bearing device.

Always for this reason, the annular element 9 is coated, on the surface thereof contacting the bottom element 2, with dielectric material strips in order to electrically insulate the bottom element 2 from the top element 6.

Figure 3:
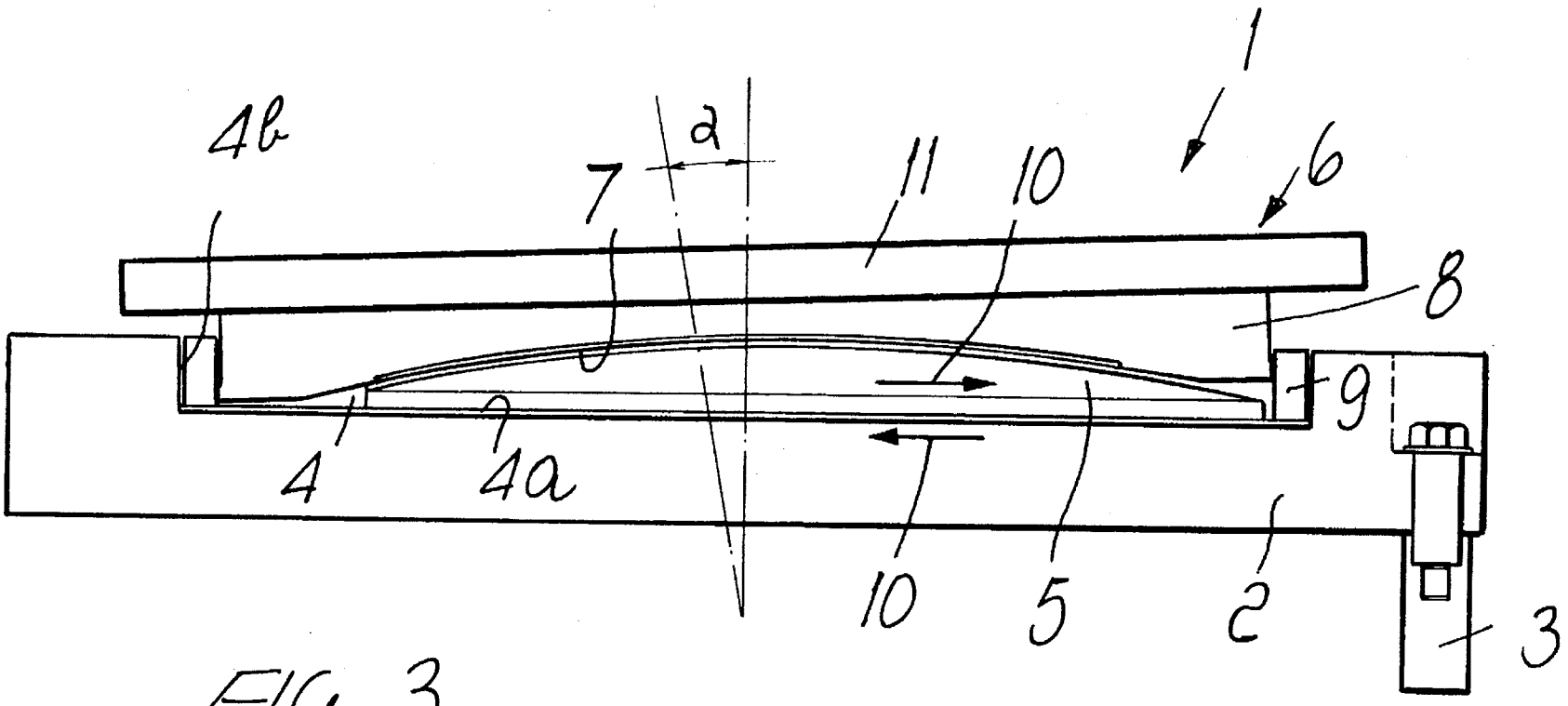
FIG. 3 illustrates that same bearing device, as cross-sectioned through a vertical plane and represented in a rotary displacement condition of a top element thereof with respect to a bottom element thereof.

The rotary capability of the top element 6 with respect to the bottom element 2, by means of the existing spheric cap coupling, has been clearly shown in FIG. 3 by the angle $\alpha$, whereas the sliding capability of the coupling element 5, with respect to the bottom element 2, has been stressed in the same figure by the arrows 10.

Figure 4:
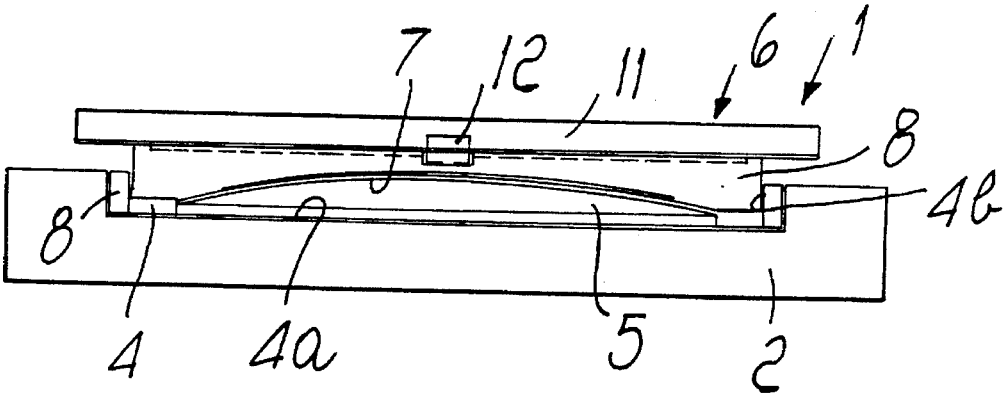
FIG. 4 is a schematic vertical cross-section view illustrating a modified embodiment of the bearing device according to the present invention.
Figure 5:
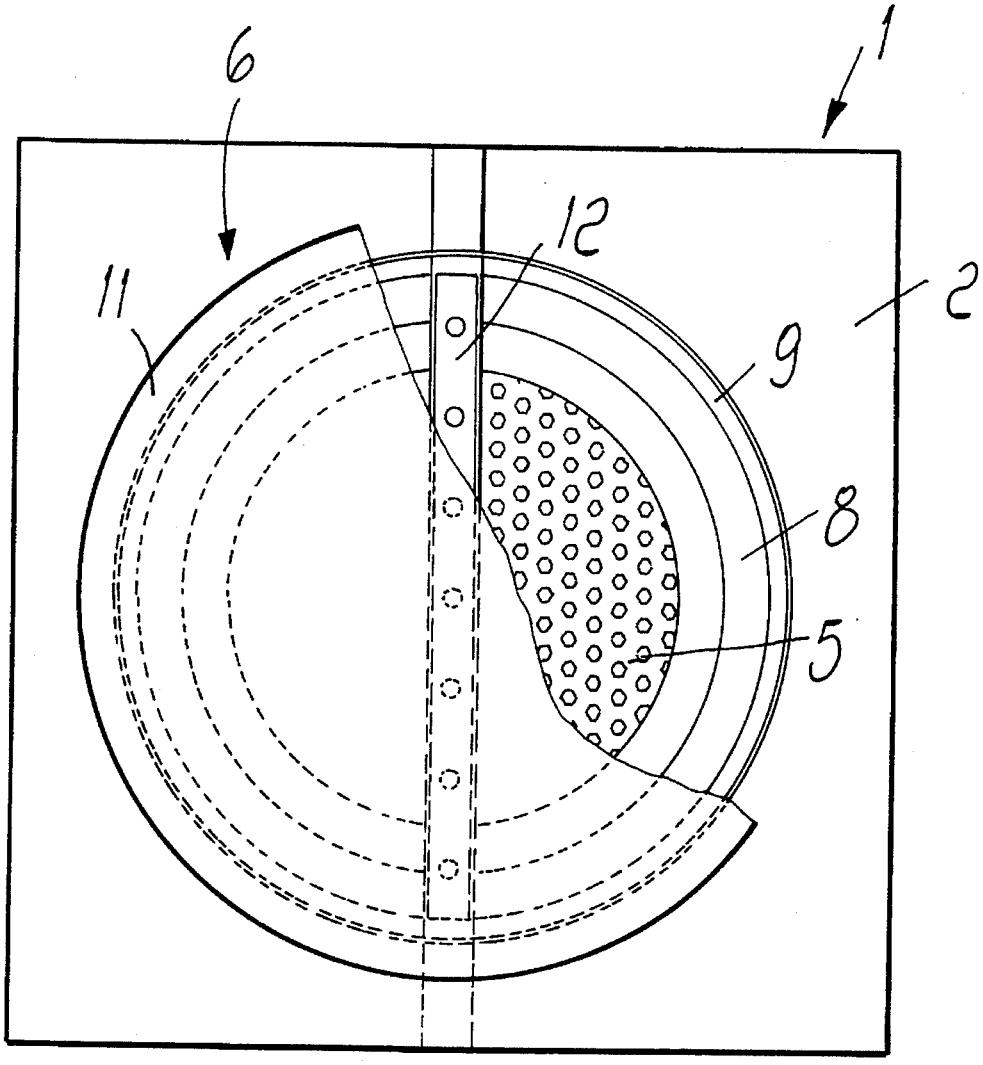
FIG. 5 is a top plan partially cross-sectioned view of the bearing device shown in FIG. 4.

If required, in addition to a capability of turning about any desired axes, of the over-structure, to which is connected the top element 6, with respect to the bottom element 2, it is also possible to provide between the plate 11 of the top element 6 and the extension 8, a sliding type of coupling, as shown in particular in FIGS. 4 and 5, in which the same reference numbers have been used as in the preceding figures.

This sliding coupling, in particular, can be made, as shown in these figures, by interposing, between the plate 11 and the extension 8, a strip element 12, engaged in a slot suitably defined on the faces of the extension 8 and plate 11, which are mutually facing one another and coupling the two elements, with a sliding capability along the longitudinal axis of the strip 12, transversely of the axis of the recess 7.

Practically, the particular configuration of the bearing device according to the present invention will allow to de-couple from one another the spheric surfaces transmitting pressure loads from those surfaces adapted to transmit horizontal pushing forces.

The sliding surface allowing to de-couple the rotary movements, is arranged between the top element 6 and the coupling element 5.

Such a de-coupling is made possible owing to the provision of the sliding surface between the bottom of the coupling element 5 and the bottom 4*a* of the recess 4, which precisely operate to allow the mechanism to operate without seizeing while holding coincident the vertical axes of the bottom element 2 and top element 6.

In consequence of the above mentioned de-coupling effect of the compression vertical load and the horizontal forces, there is obtained a great resistance of the bearing device against possible "decapping" phenomena, owing to the lacking of any relationship between the vertical loads and said pushing forces.

From the above disclosure and the observations of the figures of the accompanying drawings, it should be apparent that the bearing device according to the present invention fully achieves the intended aim and objects.

In particular, the fact is to be pointed out that a bearing device has been provided which operates in a very safe manner, with respect to the above mentioned de-capping phenomenon, thereby the device can be used also in those cases in which it was not possible to use conventional spheric cap bearing devices, because of the mentioned decapping phenomenon.

The disclosed bearing device is susceptible to several modifications and variations, all of which will come within the inventive idea scope.

Moreover, all of the details, can be replaced by other technically equivalent elements.

In practicing the invention, the used materials, as well as the contingent size and shapes can be any, depending on requirements.

We claim:

1. A spheric cap bearing device for safely connecting elements of bridges, viaducts, and buildings, characterized in that said bearing device comprises a bottom element, in which is defined a recess engaging therein a spheric cap coupling element, said coupling element having a bottom slidably bearing on the bottom of said recess and a top element having, on a lower side thereof, a concave recess mating with a spheric surface of said coupling element.

2. A spheric cap bearing device, according to claim 1, characterized in that the bottom of the coupling element and the bottom of the recess are coated by a low friction material.

3. A spheric cap bearing device, according to claim 1, characterized in that said recess has a substantially open-top cylindric shape, and in that the top element is provided, on a lower face thereof, with an extension in which there is defined said recess, said extension projecting in said recess.

4. A spheric cap bearing device, according to claim 1, characterized in that said bearing device further comprises an annular element, coaxially engaged in said recess, against the cylindric side wall of said recess, said extension of said top element projecting in said annular element.

5. A spheric cap bearing device, according to claim 4, characterized in that said annular element is provided with surfaces contacting said bottom element which surfaces are coated by a dielectric material.

6. A spheric cap bearing device, according to claim 1, characterized in that said device comprises slidable coupling surfaces coated by an anti-friction material.

7. A spheric cap bearing device, according to claim 6, characterized in that said slidable coupling surfaces are coated by a dielectric anti-friction material.

8. A spheric cap bearing device, according to claim 1, characterized in that said top element comprises a plate, overlying said extension, and slidably associated with said extension, along a cross direction of the recess axis.

* * * * *